United States Patent [19]

Beck

[11] 4,288,482

[45] Sep. 8, 1981

[54] WEATHERSTRIP WITH SUBSTRATE OF TWO DIFFERENT MATERIALS

[75] Inventor: Frank W. Beck, Burlington, Canada

[73] Assignee: Schlegel Corporation, Rochester, N.Y.

[21] Appl. No.: 185,662

[22] Filed: Sep. 9, 1980

[30] Foreign Application Priority Data

Jan. 31, 1980 [GB] United Kingdom ..... 3267/80

[51] Int. Cl.[3] ..... D04H 11/00

[52] U.S. Cl. ..... 428/92; 49/475; 49/489; 156/72; 428/95; 428/97; 428/259

[58] Field of Search ..... 428/92, 95, 97, 259, 428/88; 156/72, 272; 49/475, 489

[56] References Cited

U.S. PATENT DOCUMENTS

| | | | |
|---|---|---|---|
| 3,175,256 | 3/1965 | Horton | 49/489 |
| 3,266,190 | 8/1966 | Jackson | 49/489 |
| 3,404,487 | 10/1968 | Johnson | 156/72 |

*Primary Examiner*—Marion McCamish
*Attorney, Agent, or Firm*—Cushman, Darby & Cushman

[57] ABSTRACT

Weatherstrip is composed of a substrate having a pile strip upstanding from one surface thereof and containing a barrier strip within the pile strip. In one embodiment the substrate is made of two different materials, one of which is a thermoplastic material that is heat sealed, by being passed over a heated bar, to prevent the edges of the weatherstrip from fraying. The other material maintains the structural integrity of the substrate during heat sealing. The substrate also has a region or strip adjacent the pile to which a flexible, impervious, barrier strip can be heat sealed, this region being of the same material as the barrier strip and of a different material than the thermoplastic material. In another embodiment the substrate may be composed entirely or partly of the thermoplastic material, and the same thermoplastic material is extruded onto the back of the substrate.

15 Claims, 5 Drawing Figures

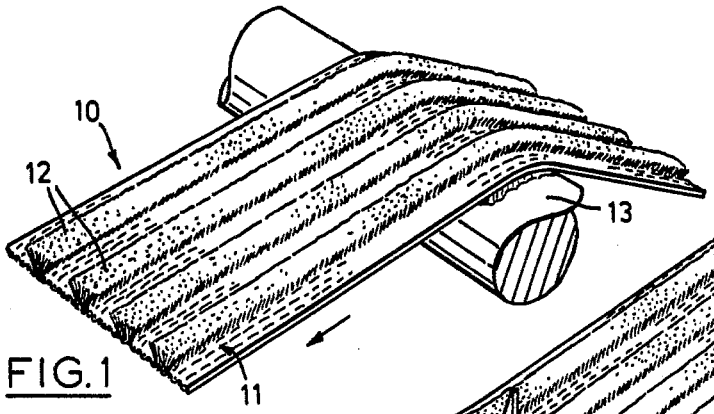
FIG. 1
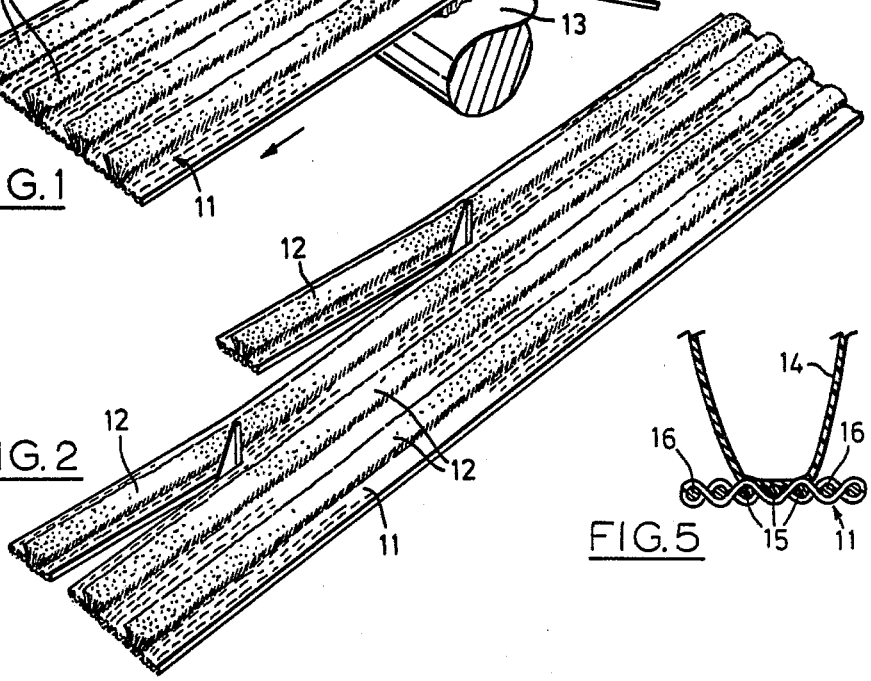
FIG. 2
FIG. 5
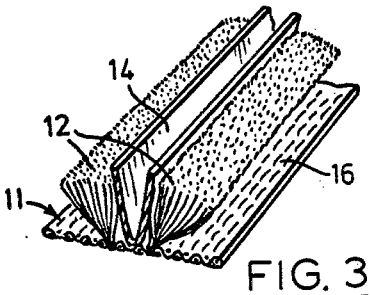
FIG. 3
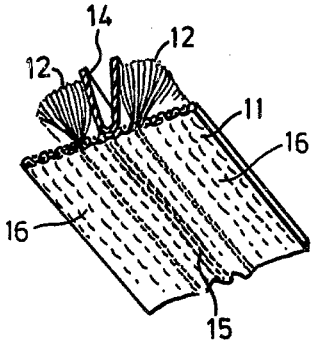
FIG. 4

WEATHERSTRIP WITH SUBSTRATE OF TWO DIFFERENT MATERIALS

This invention relates to flexible weatherstrip and methods for making flexible weatherstrip. The weatherstrip may be used as a perimeter seal, for example, and is particularly suitable for doors and windows, although its uses are not limited thereto.

For a number of years weatherstrip sold under the trade mark Fin-Seal has been commercially available. This type of weatherstrip and methods for making it are described in U.S. Pat. No. 3,175,256, R. C. Horton, issued Mar. 30, 1965, the disclosure of which is incorporated herein by reference.

In the manufacture of Fin-Seal weatherstrip a backing or substrate, which may be formed from polypropylene yarns, for example, is woven in a loom. During the weaving operation a plurality of spaced apart, parallel, pile strips also are woven into the backing and are arranged to project upwardly therefrom. Typically the pile is formed by yarns such as filament polypropylene yarns that have been siliconed and ultraviolet stabilized.

Following the weaving operation a suitable plastic material, e.g., polypropylene, is extruded onto the back of the substrate, i.e., the face of the substrate opposite to that from which the pile strips project. This step secures the pile in place, since the pile yarns are woven through the substrate and appear on the back surface thereof, increases the rigidity of the substrate and permits the substrate to be slit between the pile strips without fraying.

After the extrusion step the substrate is slit between the pile strips to form individual lengths of weatherstrip each consisting of a backing or substrate and a single pile strip upstanding therefrom.

Finally a barrier strip of impervious, flexible, sheet material, which may be polypropylene, for example, is positioned within the pile strip running the length thereof and is secured to the substrate, e.g., by heat sealing.

In some cases it may be desirable for the barrier strip to be made from a different material than the material or materials which are desired for the substrate. For example, in order to provide a substrate that can be surface mounted on a vinyl window, e.g., by a heat sealing operation, at least the lower surface of the substrate should be composed, at least in part, of vinyl. On the other hand, polypropylene is a particularly desirable material for the barrier strip. The problem is that vinyl and polypropylene cannot be conveniently heat sealed together.

An object of an aspect of this invention is to provide an improved weatherstrip which uses different materials in the substrate and for the barrier strip and yet which is constructed so as to permit the barrier strip to be heat sealed to the substrate.

An object of an aspect of this invention is to provide an improved technique for securing the barrier strip in place and preventing the substrate from fraying when slit and the novel resulting product.

In accordance with one aspect of this invention there is provided a flexible material for use as weatherstripping comprising a flexible substrate of woven strands of material; a pile strip of resilient fibers upstanding from said substrate, secured thereto and extending longitudinally of said substrate; and a barrier strip of impervious, flexible sheet material located within or immediately beside said pile strip, secured to said substrate and also extending longitudinally of said substrate; said strands of said substrate being composed of at least first and second different polymeric materials and a structural integrity maintaining material; said first polymeric material being a heat sealable material, being the same material as that of said barrier strip, being located in a region adjacent to said pile strip and extending longitudinally of said substrate to provide a region in said substrate to which said barrier strip is heat sealed; said second polymeric material and said structural integrity maintaining material being located laterally on either side of said region; said second polymeric material being a thermoplastic material distributed throughout said substrate in such a way that when said thermoplastic material is melted and then solidified, said strands of material become bonded together so that said substrate can be cut without fraying of the resulting edge, said thermoplastic material located laterally on either side of said region also being located at least on the side of said substrate opposite from the side from which said fibers upstand to provide a surface which can be heat sealed to compatible material; said structural integrity maintaining material being distributed throughout said thermoplastic material in such a way that when said thermoplastic material is melted, said structural integrity maintaining material preserves the structural integrity of said substrate.

In accordance with another aspect of this invention there is provided a flexible material for use as weatherstripping comprising a flexible substrate of woven strands of material; a pile strip of resilient fibers upstanding from said substrate, secured thereto and also extending longitudinally of said substrate; and a barrier strip of impervious, flexible sheet material located within or immediately beside said pile strip, secured to said substrate and also extending longitudinally of said substrate; said substrate in the region thereof adjacent to said barrier strip comprising a heat sealable material that is of the same material as said barrier strip, thereby providing a region in said substrate to which said barrier strip is heat sealed, at least the lower surface of said substrate opposite to the surface thereof from which said pile strip upstands and on either side of said region being composed at least in part of a thermoplastic material that is different than said material of said barrier strip.

This invention will become more apparent from the following detailed description, taken in conjunction with the appended drawings, in which:

FIG. 1 illustrates one step in the formation of weatherstrip embodying the invention in which the substrate of the weatherstrip is being heat sealed;

FIG. 2 shows the weatherstrip being split;

FIG. 3 is a perspective view from the top of the finished weatherstrip;

FIG. 4 is a perspective view from the bottom of the weatherstrip shown in FIG. 3; and FIG. 5 is a transverse section through the weatherstrip of FIG. 4 with the pile omitted for the sake of clarity.

In accordance with one aspect of this invention, instead of fabricating the flexible backing or substrate of the weatherstrip of woven strands of polypropylene, it is fabricated of woven strands of either a thermoplastic material and a thermosetting material; two thermoplastic materials that have different melting points; or a thermoplastic material and some other material having a higher melting point. The pile strips, which are composed of resilient fibers, can be woven into the substrate in the same way as previously described, i.e., during the weaving of the substrate on a loom. However, in this embodiment of the invention, instead of then having to extrude a suitable plastic material onto the back of the substrate, heat simply is applied to the back of the substrate to an extent sufficient to cause the thermoplastic material to melt. This seals the substrate by bonding the strands together, secures the pile strips in place and prevents fraying of the substrate when it subsequently is slit.

In accordance with the invention, in the region where the pile strips are located, the substrate is fabricated of the same material as the barrier strip. The material in question is selected to be heat sealable, so that the barrier strip can be heat sealed readily to the substrate.

The material of the substrate that does not melt provides the necessary structural integrity for the substrate when melting of the other material takes place to ensure that the substrate does not fall apart and that the pile strips remain in place.

While it will be readily apparent to those skilled in the art that a wide variety of materials can be used for the substrate, particularly satisfactory results have been achieved with vinyl coated polyester yarns. Strictly by way of example, and not by way of limitation, other materials that may be used in the substrate are vinyl, polypropylene, polyester, nylon, rayon and cotton, but it must be remembered that in this embodiment of the invention a thermoplastic material must be present together with some other material that will maintain the structural integrity of the substrate when heat sufficient to melt the substrate is applied thereto.

Strictly by way of example, and not by way of limitation, entirely satisfactory results have been achieved using vinyl coated polyester yarns 3000 denier after coating (1000/192 uncoated) in the warp and 675 denier after coating (150/30 uncoated) in the weft. In this particular example the pile strips were composed of 1050/84/0.52 gray polypropylene, siliconed and ultraviolet stabilized. Heat sealing was accomplished by passing the substrate over a brass rod heated to a temperature between 440° F. and 460° F. at a speed of 3.1 feet per minute.

It will be appreciated that if two thermoplastic materials having different melting points are employed for the substrate, there must be a sufficiently large difference in their melting points that the required structural integrity is preserved during melting of the lower melting point material.

Any suitable material can be employed for the pile. The fibers of the pile should be resilient and durable, however. Polypropylene is a preferred material.

Following the heat sealing operation, the substrate is slit in a conventional manner, and as previously described.

The final step is placement of the barrier strip of impervious, flexible, sheet material lengthwise within or immediately beside the pile and the securing of the strip to the substrate. This is achieved by a heat sealing operation in a now known manner (see the aforementioned U.S. Patent), but, in accordance with the instant invention, the substrate in the region of the pile is made of the same material as the barrier strip, and this material is heat sealable, thereby making it possible to heat seal the barrier strip to the substrate. This makes it possible for the material of the barrier strip to be different from either or both of the materials from which the part of the substrate other than the aforesaid region is made, so that the different properties of the various materials in their different applications can be utilized.

Referring to FIG. 1, the material emerging from the loom is shown at 10 and consists of a substrate or backing 11 of woven yarns or strands formed of the different materials referred to hereinbefore. The pile strips are shown at 12. This material passes over a heated bar 13 which melts the thermoplastic material in the substrate bonding the strands together.

In FIG. 2 the slitting operation is shown. This is a conventional operation and needs no detailed explanation.

The finished product is shown in FIG. 3 where the barrier strip heat sealed to substrate 11 is shown at 14. Of course, the barrier strip may assume other forms than that shown in FIGS. 3 and 4. It may be a single sheet of material, for example, and it may be located either within pile 12, as shown, or immediately beside and to one side of pile 12.

In order to facilitate the securing of barrier strip 14 to substrate 11 by heat sealing, it is important that the barrier strip and the part of the substrate to which it is to be secured be of the same heat sealable material. The barrier strip may be fabricated of any suitable material, but polypropylene frequently is used. In this case substrate 11 is formed, as shown in FIGS. 4 and 5, with a central strip 15 of polypropylene to which barrier strip 14 can be heat sealed readily. As best shown in FIG. 5, strip 15 in this embodiment is composed of three strands of material running lengthwise of substrate 11 and composed of the same material as barrier strip 14. On the other hand, the two parts 16 of the substrate laterally on either side of the central strip 15 are composed of vinyl coated polyester yarns, for example.

It will be appreciated from the foregoing that in this embodiment substrate 11 is formed from at least two different polymeric materials and at least one other material, which also may be polymeric, and which provides the required structural integrity when the heat sealing operation shown in FIG. 1 takes place. One of the first-mentioned polymeric materials is used in strip 15, is heat sealable and is of the same material as barrier strip 14. The other of the first-mentioned polymeric materials is different from that used in strip 15, is thermoplastic and is the material which melts during the heat sealing operation shown in FIG. 1. This does not necessarily mean that three different materials are used in the substrate, since the same material may be used in strip 15 as is used to maintain structural integrity of the substrate during the heat sealing operation of FIG. 1.

The thermoplastic material and the structural integrity maintaining material are located laterally on either side of region or strip 15 and are distributed throughout each other in such a way that when the thermoplastic material is melted and then solidified, the strands of the substrate become bonded together, so that substrate 11 can be cut without fraying of the resulting edge, and the structural integrity maintaining material preserves the structural integrity of substrate 11 while the thermoplastic material is in its soft or melted condition. For example, where vinyl is used as the thermoplastic material and polyester as the structural integrity maintaining material, polyester may be used in the fill and both vinyl and polyester in the warp. Of course, the fill yarns will pass through strip 15, but this will not adversely affect the heat sealable characteristics thereof or prevent the barrier strip from being heat sealed thereto.

It should be clear from the foregoing that the thermoplastic material is located at least on the lower side of substrate 11, i.e., the side opposite to that from which the fibres of pile strips 12 upstand, to provide a surface which can be heat sealed to compatible material. In this respect an advantageous feature of weatherstrip of the type hereinbefore described, particularly where the backing thereof is made of vinyl coated polyester yarns, is the fact that such a weatherstrip can be surface mounted, as contrasted with the more expensive form of mounting commonly used involving provision of an extrusion with a T-slot therein to receive the backing. Surface mounting can be achieved by heat sealing or by using an adhesive compatible with the backing and the surface on which it is to be mounted. Where this surface also happens to be vinyl, a suitable solvent or chemical can be used to render the vinyl tacky and capable of being adhered in a vinyl to vinyl seal, or the vinyl can be heat sealed. As is well known, it is difficult to bond polypropylene to a mounting surface, which is why extrusions with T-slots have been used with weatherstrips having polypropylene backing. Of course, to achieve this heat sealing effect, the thermoplastic material must be present on the underside of substrate 11, as it is in the regions to either side of strip 15.

It also should be noted that at the time that the backing is sealed in the operation shown in FIG. 1, it may be embossed, thereby increasing its surface area available for adhesion. If desired, the upper surface of the backing on either side of each pile strip also could be embossed using a heated embossing roller, for example. In this manner decorative or graphic effects may be achieved.

While in the embodiment of the invention shown in FIG. 3 backing 11 is wider than pile 12, this is not essential if the weatherstrip is to be surface mounted rather than mounted in a T-slot. In this case backing 11 need only be slightly wider than pile 12.

While it is preferred that pile strips 12 be woven into substrate 11, if desired, pile strips may be secured to substrate 11 by a flocking technique.

The embodiment of the invention previously discussed avoids the necessity of an extrusion step where a plastic material is extruded onto the back of the substrate. However, this invention also is applicable to weatherstripping made with the inclusion of such a step. In this case, instead of employing a heated bar 13, the same thermoplastic material as is employed in the substrate is extruded over the lower surface of the substrate. In this embodiment it is not necessary for the substrate to include structural integrity maintaining material, although it could, and it may be composed entirely of the thermoplastic material. For example, the substrate may be woven entirely of vinyl yarns (except for strip 15) and vinyl extruded onto the back of the substrate. In this embodiment of the invention what is required is that there be sufficient thermoplastic material, e.g., vinyl, at the lower surface of the substrate that the vinyl extruded onto the back of the substrate can bond to it. The extruded vinyl serves to prevent fraying of the substrate when it is cut and also provides a surface that can be heat sealed to a vinyl window to surface mount the weatherstrip. On the other hand, with this embodiment mounting in a T-slot also is possible.

While preferred embodiments of this invention have been described in detail, those skilled in the art will appreciate that changes and modifications may be made thereto without departing from the spirit and scope of the invention as defined in the appended claims.

I claim:

1. A flexible material for use as weatherstripping comprising a flexible substrate of woven strands of material; a pile strip of resilient fibers upstanding from said substrate, secured thereto and extending longitudinally of said substrate; and a barrier strip of impervious, flexible sheet material located within or immediately beside said pile strip, secured to said substrate and also extending longitudinally of said substrate; said strands of said substrate being composed of at least first and second different polymeric materials and a structural integrity maintaining material; said first polymeric material being a heat sealable material, being the same material as that of said barrier strip, being located in a region adjacent to said pile strip and extending longitudinally of said substrate to provide a region in said substrate to which said barrier strip is heat sealed; said second polymeric material and said structural integrity maintaining material being located laterally on either side of said region; said second polymeric material being a thermoplastic material distributed throughout said substrate in such a way that when said thermoplastic material is melted and then solidified, said strands of material become bonded together so that said substrate can be cut without fraying of the resulting edge, said thermoplastic material located laterally on either side of said region also being located at least on the side of said substrate opposite from the side from which said fibers upstand to provide a surface which can be heat sealed to compatible material; said structural integrity maintaining material being distributed throughout said thermoplastic material in such a way that when said thermoplastic material is melted, said structural integrity maintaining material preserves the structural integrity of said substrate.

2. The flexible material of claim 1 wherein said first polymeric material and the material of said barrier strip is polypropylene.

3. The flexible material of claim 1 wherein said second polymeric material is vinyl and said structural integrity maintaining material is polyester.

4. The flexible material of claim 3 wherein said first polymeric material and the material of said barrier strip is polypropylene.

5. The flexible material of claim 3 wherein said vinyl is a coating on said polyester.

6. The flexible material of claim 5 wherein said first polymeric material and the material of said barrier strip is polypropylene.

7. The flexible material of claim 6 wherein said pile strip is of polypropylene.

8. The flexible material of claim 5 wherein said strands are vinyl coated polyester strands.

9. The flexible material for use as weatherstripping comprising a flexible substrate of woven strands of material; a pile strip of resilient fibers upstanding from said substrate, secured thereto and also extending longitudinally of said substrate; and a barrier strip of impervious, flexible sheet material located within or immediately beside said pile strip, secured to said substrate and also extending longitudinally of said substrate; said substrate in the region thereof adjacent to said barrier strip comprising a heat sealable material that is of the same material as said barrier strip, thereby providing a region in said substrate to which said barrier strip is heat sealed, at least the lower surface of said substrate opposite to the surface thereof from which said pile strip upstands and on either side of said region being composed at least in part of a thermoplastic material that is different than said material of said barrier strip.

10. A flexible material according to claim 9 wherein said thermoplastic material is vinyl.

11. A flexible material according to claim 10 wherein said heat sealable material and said material of said barrier strip is polypropylene.

12. A flexible material according to claim 11 wherein said pile strip is of polypropylene.

13. A flexible material according to claim 11 including a strip of said thermoplastic material extruded onto said lower surface and adhered thereto.

14. A flexible material according to claim 10 including a strip of said thermoplastic material extruded onto said lower surface and adhered thereto.

15. A flexible material according to claim 9 including a strip of said thermoplastic material extruded onto said lower surface and adhered thereto.

* * * * *